United States Patent [19]

Skoting

[11] 3,947,064

[45] Mar. 30, 1976

[54] DEVICE FOR HANDLING SHEET MATERIAL

[75] Inventor: Lars-Göran Skoting, Kristinehamn, Sweden

[73] Assignee: AB Casco, Stockholm, Sweden

[22] Filed: Mar. 8, 1974

[21] Appl. No.: 449,582

[52] U.S. Cl. ..... 294/67 E; 214/620; 294/74

[51] Int. Cl.[2] ..... B66C 1/16

[58] Field of Search ..... 294/67 R, 67 B, 67 BA, 294/67 DB, 67 E, 67 EA, 74, 75, 76, 77, 81 R; 214/10.5 R, 620

[56] References Cited

UNITED STATES PATENTS

| | | | |
|---|---|---|---|
| 641,961 | 1/1900 | Hill | 294/75 |
| 2,433,523 | 12/1947 | Mahan et al. | 294/74 |
| 2,622,540 | 12/1952 | Stewart et al. | 294/74 X |
| 2,696,317 | 12/1954 | Toffolon | 294/74 X |
| 2,941,683 | 6/1960 | Fowler | 214/620 |
| 2,960,244 | 11/1960 | Strong | 214/10.5 R |
| 3,180,671 | 4/1965 | Bachmann | 294/81 R |

*Primary Examiner*—Evon C. Blunk
*Assistant Examiner*—Johnny D. Cherry
*Attorney, Agent, or Firm*—Fred Philpitt

[57] ABSTRACT

This invention relates to a device for handling and transporting bundles of large sheets.

1 Claim, 6 Drawing Figures

DEVICE FOR HANDLING SHEET MATERIAL

BACKGROUND

The usual method of transporting bundles of large sheets is to place them on wooden pallets. Because bundles of large sheets can weight a great deal, the pallets used to support them have to be of very sturdy construction in order to sustain such weight. Building such sturdy pallets is rather expensive, the pallets occupy valuable space in a store room, and the weight of the pallet itself is a factor in transportation costs.

It is therefore an object of this invention to provide an inexpensive light weight means for lifting and transporting bundles of large sheets, and which occupy much less space than ordinary pallets.

THE INVENTION GENERALLY

Considered from one aspect, the present invention involves a device for handling material comprising in combination:

a. two spaced apart elongated rod-like members,
b. a sheet of flexible material extending between said two-spaced apart elongated rod-like members,
c. means for securing the opposed longitudinal edges of said sheet to said two spaced apart elongated rod-like members,
d. a lifting yoke,
e. at least two interconnection means connecting a first set of spaced apart points on one side of said yoke to a second set of spaced apart points on one of said elongated rod-like members,
f. at least two other interconnection means connecting a third set of spaced apart points on the other side of said yoke to a fourth set of spaced apart points on the outer of said elongated rod-like members,
g. the linear distance between said first set of spaced apart points and said third set of spaced apart points being greater than the linear distance between said second set of spaced apart points and said fourth set of spaced apart points, whereby the interconnection means will diverge outwardly in an upward direction and tend to maintain the sheet of flexible material in a stretched condition when the yoke is lifted.

THE INVENTION MORE SPECIFICALLY

Two specific embodiments of my invention are illustrated in the drawings wherein.

Figure 1:
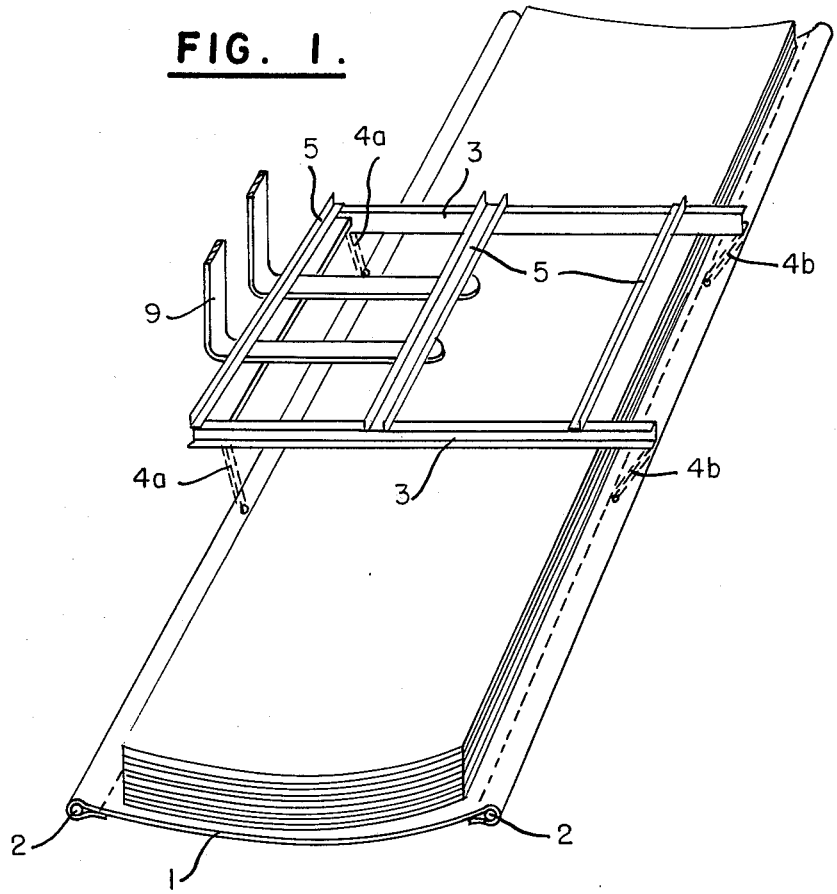
FIG. 1 is a top prospective view a first embodiment of my invention.
Figure 3:
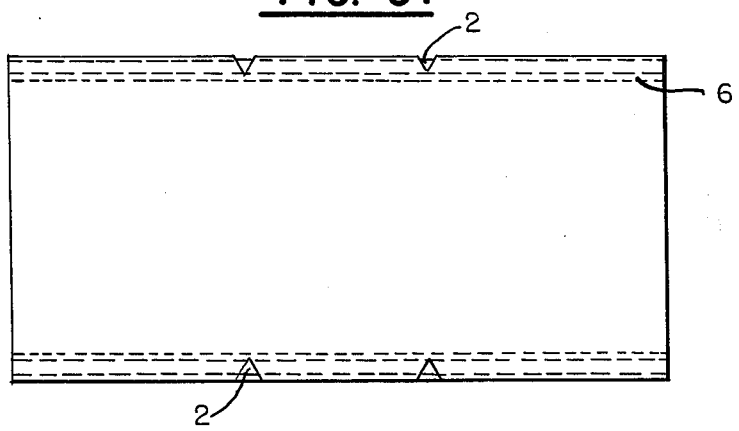
FIG. 3 is a plan view of the rod-like members and sheet of flexible material shown in FIG. 1.
Figure 2:
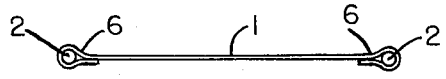
FIG. 2 is an end sectional view of the rod members and the intermediate sheet of flexible material shown in FIG. 1.

Referring now to the drawings, it will be seen that the two elongated rod-like members 2 are spaced apart in an essentially parallel relationship. A sheet of flexible material 1 extends between these rod-like members 2 and the opposed longitudinal sides of the sheet 1 are secured to the elongated rod-like members by sewing or stitching the ends of the flexible material 1 into a loop 6 around the rod-like members 2. Alternatively, the flexible material 1 can consist of one large tube and the two rod-like members 2 can be positioned in the opposite flattened portions of such a tube.

A lifting yoke is positioned above the sheet 1 and is seen to consist of at least two elongated members 3 and several cross members 5. This yoke member is adapted to be lifted by the arms of a fork lift 9.

A plurality of interconnection means 4a and 4b (such as chains, straps, cables, etc.) connect the yoke to the rod-like members 2. The distance between the points on the yoke member to which interconnection means 4*a* and 4*b* are connected is greater than the linear distance between the points on the rod-like members 2 to which the interconnection means 4*a* and 4*b* are connected. With this arrangement the interconnection means will diverge outwardly in an upward direction and tend to maintain the sheet of flexible material 1 in a stretched or taut condition when the yoke is lifted with a load of sheets thereon.

The rod-like members 2 are preferably strong metallic tubes or rods and the sheet of flexible material is preferably some sort of a carpet or coated fabric material.

Spaced apart openings are provided in the sheet 1 so that the interconnection means (4*a* and 4*b*) can connect directly to the rod-like members 2.

When the yoke is lifted with a load of sheet material the sheet of flexible material 1 will hang in a slight bow or arch, but this presents no problem with most stacks of sheet material.

Instead of a carpet or coated fabric the sheet of flexible material can be composed of a plastic tube or woven plastic.

Figure 4:
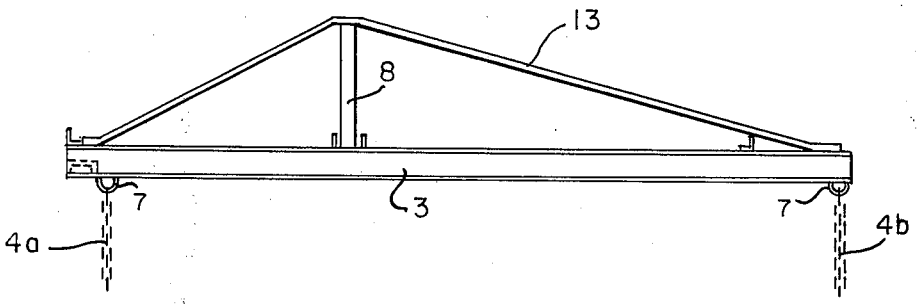
FIG. 4 is a side view of a second embodiment of a lifting yoke in accordance with the invention.
Figure 5:
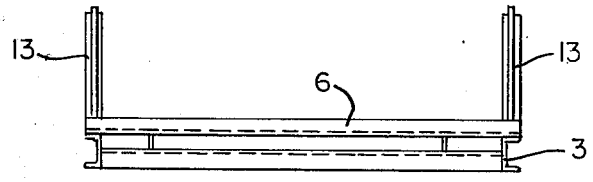
FIG. 5 is an end view of a second embodiment of a lifting yoke in accordance with the invention.
Figure 6:
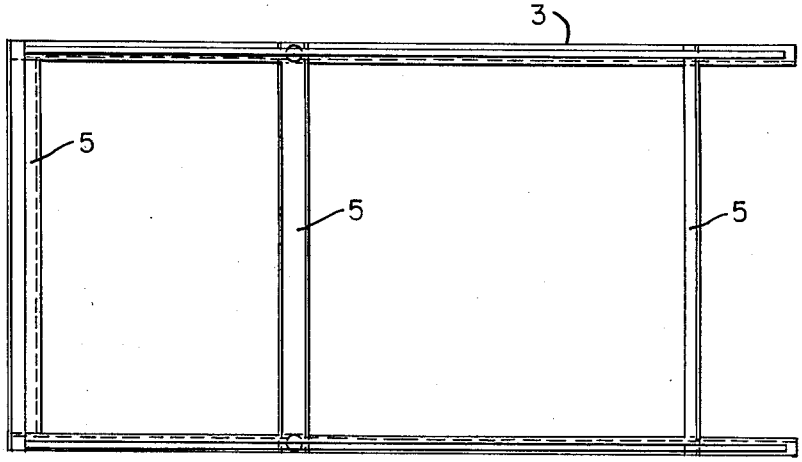
FIG. 6 is a plan view of a lifting yoke in accordance with a second embodiment of the invention.

FIGS. 4, 5, and 6 illustrate a slightly different yoke arrangement wherein the yoke member is provided with a vertically extending bracing members 8 and 13. Also, these figures show that a ring member 7 may be employed to permit swivelling of the interconnecting means 4a and 4b.

More or less detailed claims will be presented hereinafter and even though such claims are rather specific in nature, those skilled in the art to which this invention pertains will recognize that there are obvious equivalents for the specific constructions recited therein. Some of these obvious equivalents are disclosed herein, other obvious equivalents will immediately occur to one skilled in the art and still other obvious equivalents could be readily ascertained upon rather simple, routine, non-inventive experimentation. Certainly no invention would be involved in substituting one or more of such obvious equivalents for the constructions specifically recited in the claims. I intend that all such obvious equivalents be encompassed within the scope of this invention and patent granted in accordance with the well-known doctrine of equivalents.

What I claim is:

1. A structure for lifting and transporting a bundle of normally-flexible sheet materials, comprising;

a. a sling-type bundle support means, including; (1) a generally-rectangular, flexible sheet of material slightly larger than said bundle and (2) an elongated, rigid, rod-like member extending along and directly coupled to and supporting each of two opposed side edges of said flexible sheet;

b. a generally-flat, rigid lifting frame means having a width greater than the width of said support means from one of said rod-like members to the other when said flexible sheet is stretched flat between said rod-like members and adapted to be supported on the arms of a fork lift in a generally-horizontal plane;

c. a first set of a plurality of elongated, flexible connecting means, each of said connecting means having one end directly and fixedly attached to one of said rod-like members and the other end fixedly attached to said frame means; and d. a second set of a plurality of elongated, flexible connecting means, each of said connecting means having one end directly and fixedly attached to the other of said rod-like members and the other end fixedly attached to said frame means;

e. the distance between the points of attachment of said first and second sets of connecting means to said frame means being greater than said width of said support means from one of said rod-like members to the other when said flexible sheet is stretched flat between said rod-like members, whereby said sets of connecting means diverge outwardly and upwardly to thereby suspend said support means below said frame means and stretch said flexible sheet between said rod-like members when said frame means is lifted.

* * * * *